US006003572A

United States Patent [19]

Uhmeier

[11] Patent Number: 6,003,572

[45] Date of Patent: Dec. 21, 1999

[54] PROCESS FOR MAKING WOOD CHIPS

[75] Inventor: Andreas Uhmeier, Stockholm, Sweden

[73] Assignee: STFI, Sweden

[21] Appl. No.: 09/068,092

[22] PCT Filed: Oct. 31, 1996

[86] PCT No.: PCT/SE96/01398

§ 371 Date: Aug. 10, 1998

§ 102(e) Date: Aug. 10, 1998

[87] PCT Pub. No.: WO97/17177

PCT Pub. Date: May 15, 1997

[30] Foreign Application Priority Data

Nov. 8, 1995 [SE] Sweden ..... 9503948

[51] Int. Cl.[6] ..... B27C 1/00; B27L 1/00

[52] U.S. Cl. ..... 144/373; 144/162.1; 144/176; 241/92; 241/298

[58] Field of Search ..... 144/162.1, 172, 144/173, 174, 176, 373; 241/28, 92, 189.1, 298, 294

[56] References Cited

U.S. PATENT DOCUMENTS

| | | | |
|---|---|---|---|
| 3,670,791 | 6/1972 | Johnson . | |
| 4,503,895 | 3/1985 | Arasmith | 144/373 |
| 4,569,388 | 2/1986 | Arasmith | 144/176 |
| 4,685,497 | 8/1987 | Mierau | 144/176 |
| 4,865,094 | 9/1989 | Stroud et al. | 144/176 |
| 5,803,143 | 9/1998 | Willis | 144/373 |

FOREIGN PATENT DOCUMENTS

| | | |
|---|---|---|
| 32397 | 9/1962 | Finland . |

*Primary Examiner*—W. Donald Bray
*Attorney, Agent, or Firm*—Banner & Witcoff, Ltd.

[57] ABSTRACT

A process and apparatus for manufacturing wood chips as raw material in the production of mechanical pulp in order to reduce energy consumption. The process includes irreversibly deforming a plurality of fibers of at least one piece of wood in a direction perpendicular to the longitudinal axis of the fibers. The wood fibers include summerwood fibers. The irreversible deformation is accomplished through mechanical treatment. The apparatus used includes one or several tools arranged so that the forces created during the process act in a direction substantially perpendicular to the longitudinal axis of the fibers so as to irreversibly deform the fibers across the grain.

21 Claims, 2 Drawing Sheets

PROCESS FOR MAKING WOOD CHIPS

FIELD OF THE INVENTION

Figure 1:
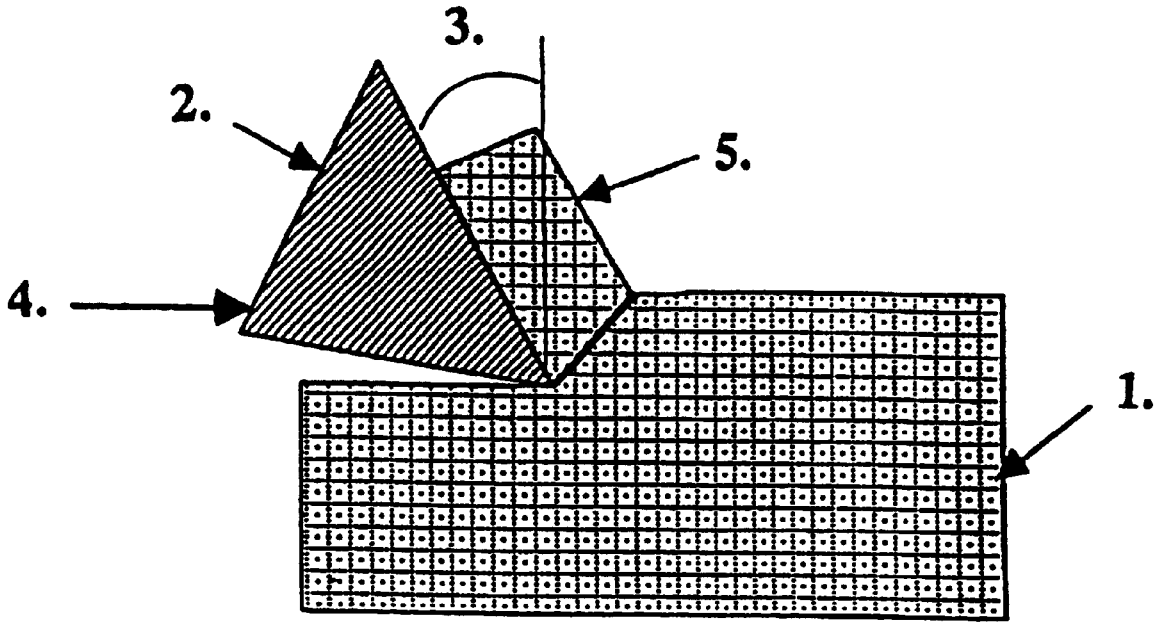

The present invention concerns a process for making wood chips as a raw material in the production of mechanical pulp, characterized in that irreversible deformation of the wood fibres, including the summerwood fibres, is accomplished in a direction across the grain, i.e. perpendicular to the longitudinal axis of the fibres, to thereby create favourable deformation of the fibres and reduce the energy consumption in the production of mechanical pulp.

BACKGROUND OF THE INVENTION

Traditionally, the raw fibre material used in the production of mechanical pulp has been subjected to a two step mechanical treatment process. The first step is known as "chipping" and includes disintegration of the wood. The second step is referred to as "refining" and involves separating the fibres and increasing their flexibility in one or two refiners. Many of the currently used processes for chipping were developed for the production of chemical pulp, before the introduction of mechanical pulp in the pulp and paper industry. In the production of chemical pulp, the fibre is attacked during chemical cooking (defibration) and is susceptible to weakening and shortening at the sites that have been mechanically deformed. As a result, fibre deformation is unwanted during the production of chemical pulp and therefore minimized.

Apparatuses and processes for chipping have tried to achieve chips of uniform size with minimal fibre deformation. For example, U.S. Pat. No. 3,304,970 describes a new way to produce wafers to avoid the deformation encountered in conventional chipping. The damage to the fibres, e.g. bruising which occurs in chipping is thought to reduce the quality of the wood chips.

Other patent publications concerning chips both for production of paper and board, highlight the benefit of splitting the raw wood material in a direction parallel to the longitudinal axis of the fibres as being less severe to the fibres. For example, U.S. Pat. No. 3,407,854 describes it as preferred to produce chips that are not compressed or damaged.

SE 463 295 concerns the adjustment of the cutting tools in chipping, expressly to avoid the risk of forming longitudinal defects, caused by the pressure, in the fibre walls.

While the industry has increased its production of mechanical pulp, the traditional methods of chipping have nevertheless remained largely unchanged. With some variations for different methods of chipping, the thickness of the chip has been on the order of 3 to 7 mm. These chips have been fed into refiners of different construction for exposing and flexibilizing the fibres. The refiners have been developed for, and adjusted to, the type of chip conventionally used in the production of chemical pulp. The energy consumption during refining is considerable. Additionally, the refining step is a very non-selective way of treating the fibres. During more prolonged refining an unwanted fibre shortening takes place. In spite of this, refining has to be performed up to a certain degree to guarantee that the main part of the fibres is exposed and flexibilized to a sufficient extent.

One special quality of the raw fibre material has gained larger importance in mechanical pulping in recent years. This is that the wood fibres, dividable as they are into fibres with thin walls and thick walls, so-called springwood fibres and summerwood fibres, respectively, have very different mechanical properties. The thick-walled fibres in the summerwood are resistant to strong loads in a direction perpendicular to their length. Whereas, the springwood fibres are more easily deformed by these strong loads applied in the same direction. The summerwood fibre can resist loads that are 10 times greater than the loads that the springwood fibre can resist. All non-selective treatment of fibres leads to more or less unwanted results. For example, refining to the extent needed to flexibilize the summerwood fibres, reduces the springwood fibres in a large extent to fines, which leads to inferior dewatering properties of the pulp and thus, weaker paper. With less extensive treatment, the summerwood fibres retain unreduced stiffness, which leads to unevenness in the paper surface and weaker paper.

The length and anal strength of the wood fibres (both tensile strength and compression strength) should be conserved to as large an extent as possible. The transversal strength of the fibre should nevertheless be reduced, making the fibre more easily collapsible. The transversal strength of the fibres can be reduced and the fibres made flatter, i.e. collapsed, by irreversibly deforming them with a cutting tool. A collapsed fibre has a substantially lower bending stiffness. The lower bending stiffness makes the fibre more easily adaptable to surrounding fibres. The number of contact points between the easily adaptable fibres in the paper thus increases and so does the density of the paper. A collapsed fibre is also flatter, which increases the area of its contact surface with other fibres.

Attempts with rolling the chips, i.e. subjecting them to forces perpendicular to the fibre's length direction, in order to reduce the energy consumption in the production of mechanical pulp, has shown little effect. This is due to the fact that the weaker fibres in the springwood are compressed first and function as a deformation buffer protecting the stronger fibres of the summerwood.

SUMMARY OF THE INVENTION

The present invention concerns a new process for producing disintegrated raw material for the production of mechanical pulp. During the disintegration step involving the transformation of the raw wood material to chips, according to the invention, the wood is subjected to such stress across the grain, i.e. in a direction perpendicular to the longitudinal axis of the fibre, that the summerwood fibres are irreversibly deformed. As a result, a more uniform pulp is achieved in refining. Further, the previously common, over extensive treatment of the springwood fibres is avoided. Simultaneously, the energy consumption of the refining is decreased. A less extensive refining leads to a lower degree of fibre cutting. This produces a pulp with higher average fibre length that results in better paper qualities, when compared to the prior art.

Characteristics of the process according to the present invention include irreversible deformation of the wood fibres across the grain, i.e. in a direction perpendicular to the fibre length. Preferably, the irreversible deformation of the fibres across the fibre length is substantially achieved without an accompanying fibre shortening.

SHORT DESCRIPTION OF THE DRAWINGS

Figure 2A:
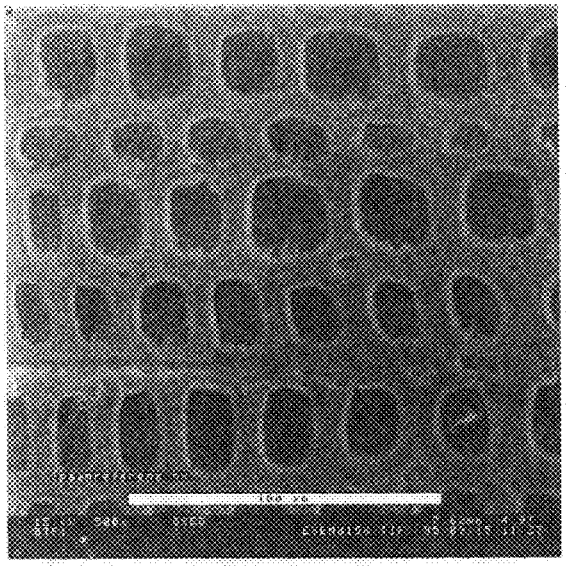
Figure 2B:
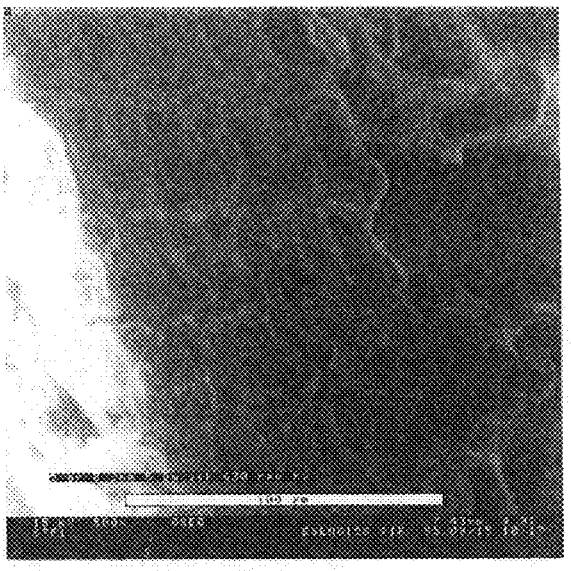

FIG. 1 is a schematic view of a cutting tool, arranged substantially parallel with the fibre length, and FIGS. 2(A) and 2(B) show an electron microscope photography of a fibre section in undeformed wood (A) and in chips produced according to the invention (B).

DESCRIPTION OF PREFERRED MODES

The present invention will be further described with reference to preferred modes and FIG. 1.

The irreversible deformation of the fibres across the grain, i.e. in a direction perpendicular to the longitudinal axis of the fibres, according to the present invention, comprises a substantial deformation of the summerwood fibres across the grain. This is achieved by subjecting the wood to a wood cutting process in which the cutting tool or tools are positioned so that the edge or edges of the cutting tool are substantially parallel to the length of the fibres. As a result, the combination of shearing strain and compression strain, created during the cutting process, acts substantially perpendicular to the longitudinal axis of the fibres.

The cutting tool or tools are positioned and the cutting operation performed in such a manner that the irreversible deformation defined above is maximized while the fibre shortening is minimized. Additionally, as a result of the position, shape and operation of the cutting tool, a splitting zone is created in the wood. This splitting zone runs through the wood slightly ahead of the cutting tool, in the direction of the tool and parallel with the fibre length. Simultaneously, the forces acting across the grain must be kept sufficiently strong to achieve the irreversible deformation of the fibres. Optimization can be performed without deviating from the scope of the invention as set forth in the appended claims.

Preferably, each cutting tool is positioned so that the chip angle 3 is less than 60 degrees, preferably between about 2 degrees and about 30 degrees and more preferably about 5 degrees. The cutting tool is further preferably positioned so that the chip thickness is in the interval between 0.2 to 2.0 mm, with a preferred thickness of about 0.5 mm. When the cutting depth is larger, the chip comprises both summerwood and springwood fibres in alternating layers, whereby primarily the weaker springwood fibres are deformed. Naturally the cutting depth is adjusted to the raw wood material and to accommodate possible species or location dependent variations, e.g. variations in the width of the annual rings.

The irreversible deformation of fibres in a direction perpendicular to the longitudinal axis of the fibres according to the present invention can also be achieved through other mechanical treatments, such as pressing or rolling of sufficiently thin chips produced by any known method or treatment in combination with the previously described process.

The present invention also comprises an apparatus for irreversibly deforming wood fibres across the grain, i.e. in a direction perpendicular to the longitudinal axis of the fibres. Such an apparatus for large scale use can be designed as a drum with internal cutting tools, e.g. knives or projecting blades. The design and configuration of the cutting tools are then chosen so that the objectives and parameters of the present invention are met. The apparatus can have some apparent similarity to a barking drum, but the mode of operation together with the specific parameters are completely different and novel for this application. This apparatus includes one or more revolving drums with inwardly oriented cutting tools and means for receiving logs. The edge or edges of the cutting tools is/are arranged substantially parallel to the longitudinal axis of the logs and the cutting angle and chip thickness are adjusted to values in the interval of 0 to 30 degrees and 0.2 to 2.0 mm, respectively. The cutting tool or tools can also be positioned on the outer perimeter of one or more of the revolving drums. An apparatus according to the present invention can also comprise means for pressing or rolling wood chips, either in combination with the above described apparatus or in combination with a conventional apparatus for preparing wood chips in the production of mechanical pulp.

According to one embodiment of the invention, the logs are treated sequentially whereby the fibres are removed layer by layer using an apparatus as described above. In this embodiment, the chips can be formed so that different fibre lengths are collected. Also, fibres having different sizes can be used depending on the sought qualities of the end product.

According to a preferred mode of the invention, the raw wood material 1, which preferably is supplied as debarked logs, is treated with one or several cutting tools 2, arranged so that the chip angle 3 is less than about 60 degrees. Preferably the chip angle is in the interval of 2 to 30 degrees, more preferably 5 degrees. Even a minor negative chip angle is possible, i.e. an arrangement of the tool so that the angle between the cutting tool and the raw wood material is less than 90 degrees in the direction of the path of the tool 4.

In treating the raw wood material according to the process of the present invention, the cutting tool or tools is/are arranged so that the formed chips 5 have a thickness in the interval of 0.2 to 2.0 mm, preferably about 0.5 mm. In this way, it is guaranteed that the chip does not comprise a number of alternating layers of springwood and summerwood, and the springwood does not function as a deformation buffer absorbing all the deformation while the summerwood escapes deformation.

The properties of the raw wood material, such as temperature and humidity, influence the result of the treatment. A person skilled in the field can, within the scope of the invention, optimize the properties of the wood, such as temperature and humidity, or through optimization of the treatment process, take these properties into account. Apart from cutting depth and chip angle, the cutting speed, the exact design of the cutting tool and the friction coefficient between the knife and the wood can be varied within the scope of the present invention.

Examples

Example 1. The influence of chip thickness on fibre length and deformation

Chips of Swedish spruce were produced in small scale experiments by fixing a piece of wood with a length of2 cm in a la the. The wood had a humidity of about 40%, thereby corresponding to industrially used wood. A cutting tool was applied to the revolving piece of wood in a manner making it possible to vary the chip angle and cutting depth/chip thickness. The peripheral velocity of the tool was between 2 and 6 m/s. The resulting samples were examined with an electron microscope and compared with electron microscope images of undeformed control samples. The degree of deformation was estimated visually. The fibre length was measured conventionally, using pulp prepared in the laboratory from the experimental chips.

Treatment with cutting depths in the interval 0.1 to 0.7 mm was examined. Satisfying results were achieved within this entire interval. However, reduced fibre lengths were found with smaller cutting depths. The results are summarized in Table 1. Examples of an undeformed and a highly deformed cross section are given in FIGS. 2(A) and (B).

TABLE 1

| Chip thickness (mm) | Fibre length (mm) | Degree of deformation |
|---|---|---|
| 0.2 | very low | high |
| 1.0 | 1.74 | ↓ |
| 1.6 | 1.86 | low |

Example 2. The influence of chip angle on deformation

The influence of the chip angle on the degree of deformation was studied using the same experimental set up as previously described. The chip angle was varied incrementally in an interval from 0 to 30 degrees. A cross section of each sample was examined with an electron microscope and the degree of deformation visually estimated. It was shown that strong and irreversible deformation of the summerwood fibres was achieved in the entire interval from about 0 to 30 degrees. The fibre condition corresponded to a condition, usually observed only after the refining step. Within the previously mentioned interval, a chip angle of about 5 degrees was shown to be most preferable under the prevailing experimental conditions.

Although the invention has been described with regard to its preferred embodiment, which constitutes the best mode presently known to the inventors, it should be understood that various changes and modifications may be made without departing from the scope of the invention which is set forth in the claims appended hereto.

I claim:

1. A process for producing wood chips for use as a raw material in the preparation of mechanical pulp, said method comprising the steps of:

A) providing at least one cutting member including at least one cutting tool having a cutting edge for engaging at least one piece of wood;

B) orienting said cutting edge parallel to a longitudinal axis of the fibres of said at least one piece of wood; and C) irreversibly deforming a plurality of said fibres of said at least one piece of wood in a direction perpendicular to the longitudinal axis of said fibres, said irreversibly deforming step including:

1) orienting said cutting tool relative to said at least one piece of wood such that a resulting chip angle of less than 60 degrees is formed during said process;

2) rotating said cutting member about an axis extending parallel to the longitudinal axis of said fibres; and 3) advancing said at least one cutting tool into said at least one piece of wood in a direction perpendicular to the longitudinal axis of said fibres so as to form the wood chips.

2. The process according to claim 1 wherein said fibres are summerwood fibres, and said step of irreversibly deforming said fibres includes the step of irreversibly deforming said summerwood fibres.

3. The process according to claim 1 further including the step of creating shearing strains within said piece of wood in the direction perpendicular to the longitudinal axis of said fibres.

4. The process according to claim 1 further including the step of creating a splitting zone in said wood at a position ahead of said cutting tool in a direction parallel to the longitudinal axis of said fibres.

5. The process according to claim 1 wherein each said wood chip has a thickness of between 0.2 and 2.0 mm.

6. The process according to claim 1 wherein said step of irreversibly deforming said fibres includes the application of rollers to said fibres.

7. The process according to claim 1 wherein said step of irreversibly deforming said fibres includes applying compressive pressure to said fibres.

8. The process according to claim 1 wherein said resulting chip angle is between 2 and 30 degrees.

9. The process according to claim 8 wherein said resulting chip angle is substantially 5 degrees.

10. A process for producing wood chips as raw material for use in the production of mechanical pulp, said method including the steps of:

A) providing a cutting tool having at least one cutting edge and means for receiving said at least one piece of wood;

B) orienting said at least one cutting edge parallel to a longitudinal axis of the fibres of said at least one piece of wood; and c) irreversibly deforming a plurality of said fibres in a direction perpendicular to the longitudinal axis of said fibres, said irreversibly deforming step including:

1) rotating said cutting tool about an axis extending parallel to the longitudinal axis of said fibres;

2) advancing said cutting edge into said at least one piece of wood; and 3) creating strains in said at least one piece of wood that extend in a direction substantially perpendicular to said longitudinal axis of said fibres.

11. The process according to claim 10 wherein said fibres are summerwood fibres, and said step of irreversibly deforming said fibres includes the step of irreversibly deforming said summerwood fibres.

12. The process according to claim 10 wherein said step of irreversibly deforming said fibres includes the step of orienting a cutting edge of said cutting tool so it extends parallel to the longitudinal axis of said fibres and so that a chip angle of less than 60 degrees is formed when said cutting tool is applied to said piece of wood.

13. The process according to claim 10 wherein said step of irreversibly deforming said fibres further includes orienting a cutting edge of said cutting tool so it extends parallel to the longitudinal axis of said fibres and so that a chip angle of between 2 and 30 degrees is formed when said cutting tool is applied to the piece of wood.

14. The process according to claim 13 wherein said formed chip angle is substantially 5 degrees.

15. The process according to claim 10 wherein each said wood chip has a thickness of between 0.2 and 2.0 mm.

16. The process according to claim 15 wherein each said wood chip has a thickness of substantially 0.5 mm.

17. The process according to claim 10 further including the step of creating a splitting zone in said wood at a position ahead of said cutting tool in a direction parallel to the longitudinal axis of said fibres.

18. The process according to claim 10 wherein said step of irreversibly deforming said fibres includes the application of rollers to said fibres.

19. The process according to claim 10 wherein said step of irreversibly deforming said fibres includes applying compressive pressure to said fibres.

20. A process for producing wood chips for use as a raw material in the preparation of mechanical pulp, said method comprising irreversibly deforming a plurality of fibres of at least one piece of wood in a direction perpendicular to a longitudinal axis of said fibres.

21. An apparatus for irreversibly deforming wood fibres across the grain of a piece of wood, said apparatus comprising:

means for receiving the piece of wood, a rotatable member having inner and outer surfaces and being capable of rotating relative to the piece of wood when operating, and a plurality of cutting tools positioned on one of said surfaces of said rotatable member for contacting the piece of wood, each said cutting tool including a cutting edge for positioning parallel to the length of the fibres of the piece of wood, said cutting edge of each cutting tool being oriented on said rotatable member so that a chip angle of between 0 and 30 degrees is formed and wood chips having thicknesses of between 0.2 mm and 2.0 mm are formed when said cutting tools are advanced into the piece of wood in a direction substantially perpendicular to the longitudinal axis of the wood fibres.

* * * * *